US005220702A

United States Patent [19]

Howell et al.

[11] Patent Number: 5,220,702

[45] Date of Patent: Jun. 22, 1993

[54] PAINT BRUSHES WITH MULTIPLE STIFFNESS BRISTLES

[76] Inventors: Marian N. Howell, 6131 B Curzon, Fort Worth, Tex. 76116; Mary M. Penner, 4727 El Campo, Fort Worth, Tex. 76107

[21] Appl. No.: 979,486

[22] Filed: Nov. 20, 1992

Related U.S. Application Data

[63] Continuation of Ser. No. 697,734, May 3, 1991, abandoned, which is a continuation of Ser. No. 259,728, Oct. 19, 1988, abandoned.

[51] Int. Cl.[5] ..... A46B 9/06

[52] U.S. Cl. ..... 15/160; 15/159.1; 15/207.2; 15/DIG. 5; 15/DIG. 6

[58] Field of Search ..... 15/159.1, 207.2, 160, 15/166, 168, DIG. 5, DIG. 6; 401/282

[56] References Cited

U.S. PATENT DOCUMENTS

| | | | |
|---|---|---|---|
| 183,758 | 10/1876 | Furter | 15/160 |
| 286,886 | 10/1883 | Williams | 15/168 |
| 857,239 | 6/1907 | Hawkins | 15/166 |
| 1,694,364 | 12/1928 | Albright | 15/159 R |
| 2,043,758 | 6/1936 | Lay | 15/159 R |
| 2,230,126 | 1/1941 | Westervelt | 15/160 |
| 2,849,740 | 9/1958 | Pauker | 15/160 |
| 3,047,898 | 8/1962 | Levite | 15/159 A |
| 4,088,413 | 5/1978 | de la Ronde | 15/159 A |
| 4,454,622 | 6/1984 | Poppendieck | 15/DIG. 5 |
| 4,483,036 | 11/1984 | Sayklay | 15/160 |
| 4,627,125 | 12/1986 | Gruns | 15/159 A |
| 4,722,111 | 2/1988 | Brodey et al. | 15/DIG. 5 |
| 4,756,039 | 7/1988 | Pardo | 15/159 R |

FOREIGN PATENT DOCUMENTS

| | | | |
|---|---|---|---|
| 560528 | 10/1932 | Fed. Rep. of Germany | 15/DIG. 6 |
| 1061287 | 7/1959 | Fed. Rep. of Germany | 15/160 |
| 1154962 | 11/1957 | France | 15/159 R |
| 1230594 | 4/1960 | France | 15/159 R |
| 454288 | 1/1950 | Italy | 15/159 A |
| 9839 | of 1894 | United Kingdom | 15/159 A |
| 374813 | 6/1932 | United Kingdom | 15/160 |
| 495686 | 11/1938 | United Kingdom | 15/159 R |

*Primary Examiner*—Harvey C. Hornsby
*Assistant Examiner*—Mark Spisich
*Attorney, Agent, or Firm*—Cushman, Darby & Cushman

[57] ABSTRACT

A watercolor brush, used to draw fine lines wherein the core of this brush is composed of short thick sable hairs with long stiff bristles dispersed therein and the outer surrounding portion of this brush is composed of long fine sable hairs. An oil/acrylic flat brush used to draw straight lines wherein the brush is composed of stiff hair such as badger or horse hair at one end of the flat brush with the remaining bristles adjacent thereto being sable.

2 Claims, 1 Drawing Sheet

PAINT BRUSHES WITH MULTIPLE STIFFNESS BRISTLES

This is a continuation of application Ser. No. 07/697,734, filed on May 3, 1991, abandoned, which is a continuation of application Ser. No. 07/259,728, filed on Oct. 19, 1988, abandoned.

BACKGROUND OF THE INVENTION

1. Field of the Invention

The present invention is generally directed to paint brushes, and more particularly, to paint brushes having groups of bristles of differing stiffnesses.

2. Description of the Prior Art

Many types of paint brushes are known in the art. Some of these brushes use bristles of varying length. U.S. Pat. No. 4,144,611 to Brown disclosed a paint brush designed to draw very fine lines. Short mink hairs are gathered to form the core of the brush and longer mink hairs are dispersed outside of the shorter ones. In order to paint very fine lines, the longer hairs are separated from each other and the shorter hairs. U.S. Pat. No. 4,088,413 to Rossignol de la Ronde discloses a liner brush having a central and a peripheral tuft of hair in which the central tuft projects beyond the peripheral tuft. The central and peripheral tufts may be of different materials or have different stiffness. The central tuft is the only portion used to draw thin lines and the peripheral tuft serves as a reservoir to store the material being applied.

Other types of paint brushes use bristles of different stiffnesses. U.S. Pat. No. 3,047,898 to Levite discloses a brush containing several longitudinal rows of bristles of different characteristics. More specifically, fine natural bristles are adjacent to coarse boar bristles. U.S. Pat. No. 1,694,364 to Albright discloses a shaving brush in which a cup-like depression is formed in the ends of the bristles for the purpose of retaining shaving cream. The core of the brush is constructed of relatively stiff bristles such as pig bristles and the outer bristles surrounding the core of the brush are composed of soft badger hair.

Other patents in the art are U.S. Pat. No. 4,627,125 to Gruns which discloses a paint brush which has a set of guide bristles and main bristles. The guide bristles are shorter in length than the main bristles and serve the purpose of being a visual aid to help prevent the painter from dipping the paintbrush too deeply into the paint. U.S. Pat. No. 4,483,036 to Sayklay discloses an artist's paint brush helpful in painting leafy vegetation such as trees by providing a plurality of tiered bristles each layer containing bristles of various length. The various length bristles are arranged to form a plurality of furcations. U.S. Pat. No. 4,610,045 to Rauch and U.S. Pat. No. 3,295,156 to Brant disclose toothbrushes with various length bristles. U.S. Pat. No. 4,091,490 to Allen discloses a skin cleansing device which uses a central tuft of human hair and a shorter peripheral tuft of a textile material. In U.S. Pat. No. 4,454,622 to Poppendieck a fingernail polish brush is disclosed having the hairs around the perimeter of the brush the shortest in length with each successive circle of hairs increasing in length ending with the last round of hairs in the center of the brush being the longest. U.S. Pat. No. 4,153,967 to Thoma discloses a circular polishing and cleaning brush. U.S. Pat. No. 3,237,233 to Adams discloses a rotary brush having soft animal fur and tougher, coarser synthetic fibers for cleaning the peripheral surfaces of rotary metal drums.

One of the major problems with paint brushes used to draw very fine lines is that the brush itself cannot store very much of the paint or other material being applied. Consequently artists need to continually dip the brush in the material to be applied. In the case of a brush designed to draw very fine lines, one might need to redip after every line drawn or to redip if a very long line needs to be drawn. Thus, this creates a great inconvenience to the artist who must interrupt her work to redip thus disturbing her concentration on her work.

Problems are also created when one wants to paint a straight line, especially if one is painting on a surface that is already painted. Typically to draw a straight line one would lay down masking tape and paint along one of its edges. A straight line was never achieved, however, because the paint would bleed under the masking tape thus blurring the line. This problem is compounded when there is already preexisting paint on the canvas because the preexisting paint has microscopic grooves. The prior art paint brushes would not allow the paint to enter the microscopic grooves thus the paint was only applied to the top surface portions of the grooves and a straight line was not drawn.

SUMMARY OF THE INVENTION

Accordingly it is a primary object of the present invention to provide paint brushes having groups of bristles of differing stiffnesses that overcome the problems identified above in the art.

According to one aspect of this invention, a watercolor brush is provided that is able to draw very fine lines without requiring the brush to be redipped after every line drawn by constructing the brush with a core of short thick hairs with long stiff bristles being disposed therein all surrounded by long fine hairs.

According to another aspect of this invention, the watercolor brush has a core of long stiff bristles surrounded by short soft or fine hairs, with the outer layer consisting of long soft hairs.

According to another aspect of the present invention, an oil/acrylic flat paint brush is provided that is able to draw straight lines on a canvas that has already been painted by constructing the brush with stiff hair along one edge of the brush and less stiff hair for the remaining portion.

In carrying out the invention, one embodiment is a watercolor brush having a brush portion composed of thick hairs and fine hairs. The core of the brush portion is formed from short thick hairs. Dispersed in this core of short thick hairs are long stiff bristles. Surrounding this core are long fine sable hairs. The long stiff bristles are of greater length than the surrounding fine hairs and the long stiff bristles form the drawing tip of the paint brush. In another aspect the core of the brush portion is formed from long stiff bristles. Surrounding this core is short thick hairs with long fine hairs surrounding the short hairs. The short thick hairs act as a reservoir holding the water and color thereby reducing the frequency with which the artist needs to redip her paint brush.

An oil/acrylic flat brush embodiment of the present invention has its brush composed of a small section of stiff hair such as badger or horse hair along one end of the brush with the remaining portion of the brush composed of sable hairs. The section of stiff hair allows the artist to draw a straight line without any bleeding even on a preexisting paint covered canvas by allowing the paint to get into the microscopic grooves in the canvas.

BRIEF DESCRIPTION OF THE DRAWINGS

Further objects and advantages of this invention will become more apparent and more readily appreciated from the following detailed description of the present invention, taken in conjunction with the accompanying drawings, of which.

DETAILED DESCRIPTION OF THE PRESENTLY PREFERRED EXEMPLARY EMBODIMENTS

The preferred embodiments of the watercolor brush and the oil/acrylic flat brush of the present invention will hereinafter be described in detail with reference to the accompanying drawings.

Figure 1:
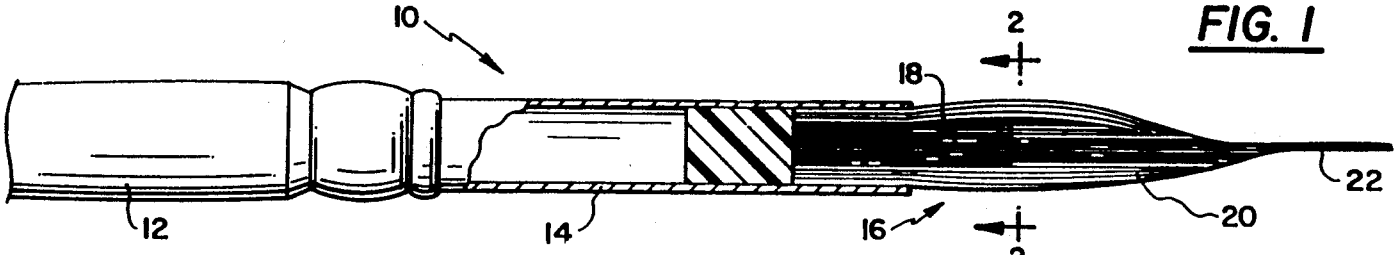
FIG. 1 is a top plan view of the watercolor brush in accordance with the present invention.
Figure 2:
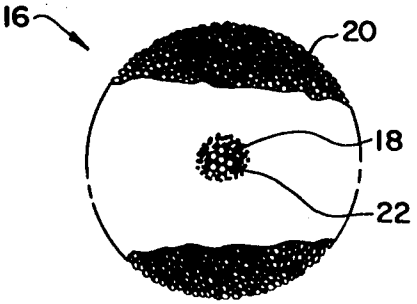
FIG. 2 is an enlarged cross-sectional view taken along line 2—2 of the brush of FIG. 1.

FIGS. 1 and 2 are views of the watercolor brush 10 in accordance with the present invention. Watercolor brush 10 incorporates a handle 12 with a ferrule 14 attached to one end of handle 12 and a brush portion 16 secured in ferrule 14. Paint brush handles, ferrules and methods of securing the brush portion in the ferrule are known in the art. Brush portion 16 is composed of a core of short thick hairs 18 with long fine hairs 20 surrounding said core and substantially longer stiff bristles 22 dispersed throughout said core of short thick hairs 18. The bristles may be natural or synthetic. In the preferred embodiment, brush portion 16 is arranged such that the core of brush portion 16 is formed by short thick sable hairs 18 and surrounding this core is long fine sable hairs 20. Dispersed in said core of short thick sable hairs 18 are long stiff bristles 22 such as horse hair. Long stiff bristles 22 extend beyond long fine sable hairs 20 and form the drawing tip of the paint brush.

The core of short thick sable hairs 18 acts as a reservoir storing water and color material in brush portion 16 Long fine sable hairs 20 also store water and color. When paint is applied to the tips of long stiff bristle 22 and the watercolor brush 10 is tilted in its painting position, water and color are delivered mainly from short thick sable hairs 18 but also from long fine sable hairs 20 to long stiff bristles 22. Long stiff bristles 22 are then ready to paint on a canvas. Because short thick sable hairs 18 and long fine sable hairs 20 act as a reservoir, the watercolor brush 10 need not be refilled as often as those of the prior art.

Figure 3:
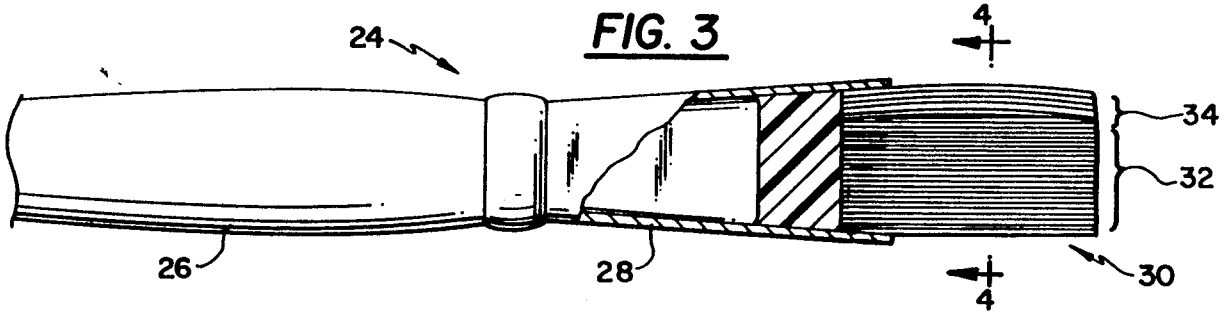
FIG. 3 is a top plan view of an oil/acrylic flat brush in accordance with the present invention.
Figure 4:
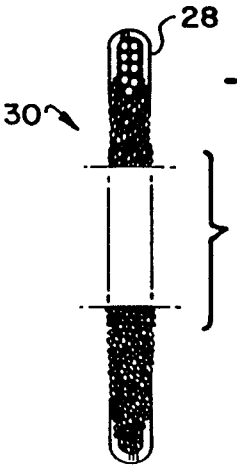
FIG. 4 is an enlarged cross-sectional view taken along line 4—4 of the brush of FIG. 3.

FIGS. 3 and 4 are views of an oil/acrylic flat brush 24 in accordance with the present invention. The oil/acrylic brush 24 incorporates handle 26 and a ferrule 28 attached to one end of handle 26, and a brush 30 secured in ferrule 28. Brush 30 is a flat brush composed of relatively less stiff bristles 32 such as sable with a small section consisting of stiff bristles 34 at one end. The stiff bristle 34 may be such hairs as horse or badger, for example. According to the preferred embodiment of the present invention, brush 30 is formed predominantly from sable hairs 32 with only a small section at one end of brush 30 composed of stiff bristles 34.

Stiff bristles 34 of the oil/acrylic brush 24 are used to draw a straight line. In order to draw a straight line, masking tape is usually placed where the straight line is desired. Then the artist with her paint brush paints along one of the edges of the tape with the stiff bristle end 34 of the oil/acrylic brush 24. The stiff bristles 34 of the present invention allow paint to enter the microscopic grooves in the canvas thereby prohibiting the paint from being applied solely to the top surface of the grooves or from seeping in under the masking tape. This results in a straight line being drawn with no "bleeding" side effects commonly associated with brushes of the prior art. Since stiff bristles 34 are located only along one edge of the brush, the other edge of the brush will leave no grooves in the new paint being applied to the canvas.

While only a few exemplary embodiments of this invention have been described in detail, those skilled in the art will readily appreciate that many modifications are possible in the preferred embodiments without materially departing from the novel teachings and advantage of this invention. Accordingly, all such variations and modifications are intended to be within the true spirit and valid scope of the invention as defined by the following claims.

What is claimed is:

1. A paint brush comprising:

a handle;

a ferrule having one end secured to said handle;

a core comprised of short thick hairs secured in said ferrule;

long stiff bristles having a length greater than said short thick hairs and secured in said ferrule such that they are dispersed within said core of short thick hairs; and long fine hairs having a length less than said long stiff bristles and greater than said short thick hairs and secured in said ferrule surrounding said core of short thick hairs and long stiff bristles, said long stiff bristles forming a drawing tip of said paint brush and said core forming a reservoir for said paint.

2. A paint brush according to claim 1 wherein both said short thick hairs and said long fine hairs are sable.

* * * * *